United States Patent [19]

Brown et al.

[11] Patent Number: 4,881,349

[45] Date of Patent: Nov. 21, 1989

[54] PANEL LOCKING SYSTEM

[75] Inventors: Mortimer Brown, Oakville; John Hellwig, Toronto, both of Canada

[73] Assignee: Teknion Furniture Systems Inc., Downview, Canada

[21] Appl. No.: 198,295

[22] Filed: May 25, 1988

[30] Foreign Application Priority Data

May 29, 1987 [CA] Canada ..... 538353

[51] Int. Cl.[4] ..... E04B 2/82

[52] U.S. Cl. ..... 52/127.11; 52/127.12; 52/584

[58] Field of Search ..... 52/584, 127.11, 239, 52/282, 127.9, 127.12; 312/257 SK; 24/333, 607

[56] References Cited

U.S. PATENT DOCUMENTS

| | | | |
|---|---|---|---|
| 2,702,732 | 2/1955 | McCarran | 52/584 |
| 2,775,799 | 1/1957 | Friderich | 52/584 |
| 3,664,073 | 5/1972 | Tucker | 52/584 |
| 3,671,063 | 6/1972 | Slayden | 52/127.11 |
| 3,811,157 | 5/1974 | Schenk | 52/584 |
| 3,965,634 | 6/1976 | Murphy | 52/584 |
| 4,204,375 | 5/1980 | Good | 52/584 |

FOREIGN PATENT DOCUMENTS

| | | | |
|---|---|---|---|
| 2405009 | 8/1975 | Fed. Rep. of Germany | 52/127.11 |
| 918873 | 2/1963 | United Kingdom | 52/584 |

*Primary Examiner*—Henry E. Raduazo

[57] ABSTRACT

Securement and cooperation between panels of an office panelling system is improved by mechanically connecting panels in a manner to maintain a particular orientation and to allow transfer of loads therebetween. The mechanical fasteners are advantageously combined with compressible strips between panels which not only deform during fastening of the fasteners, but engage the panel and distribute the clamping force to a larger area thereby adding structural rigidity.

5 Claims, 4 Drawing Sheets

FIG.1.
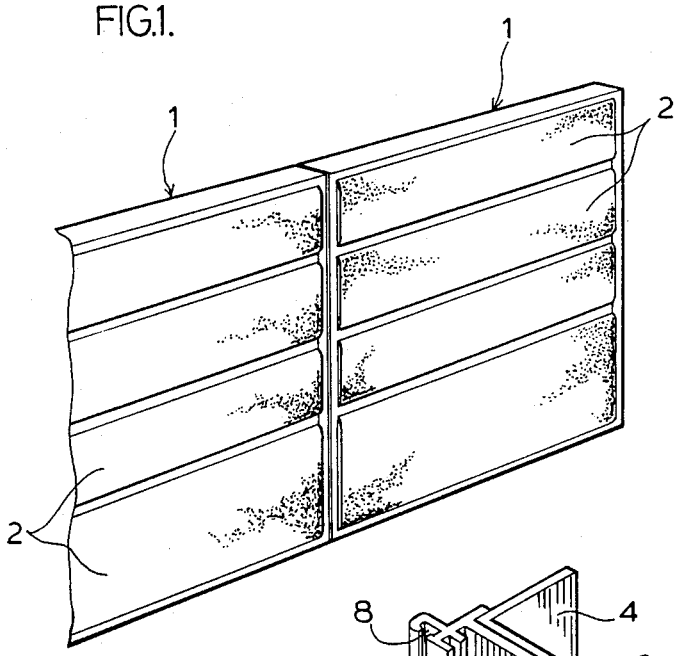
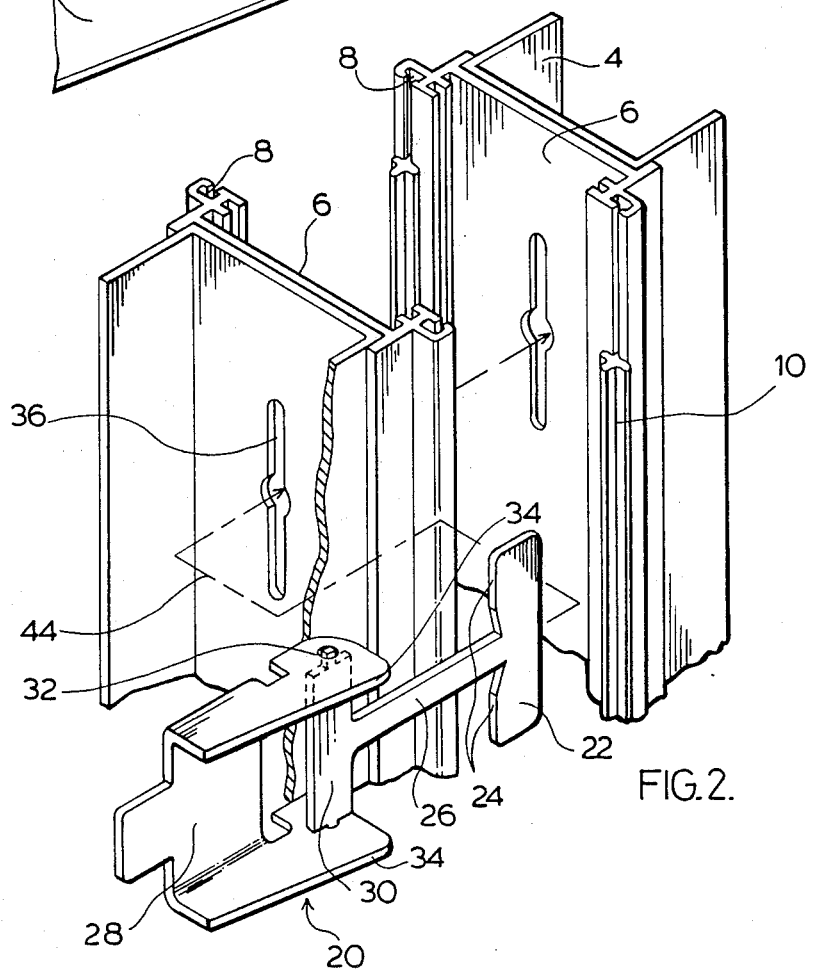
FIG.2.

FIG.6.
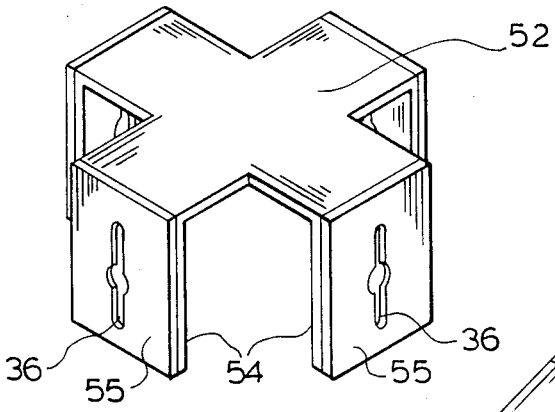
FIG.7.
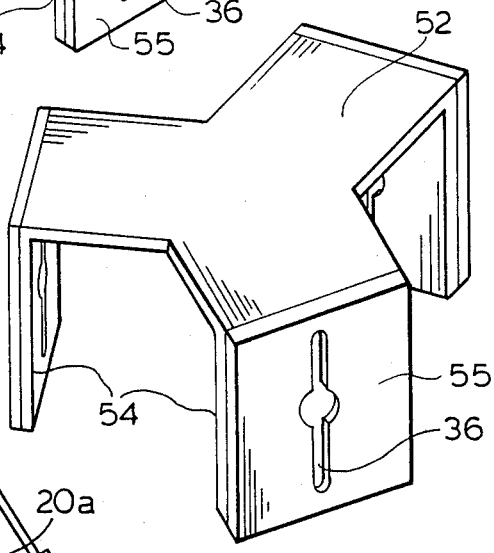
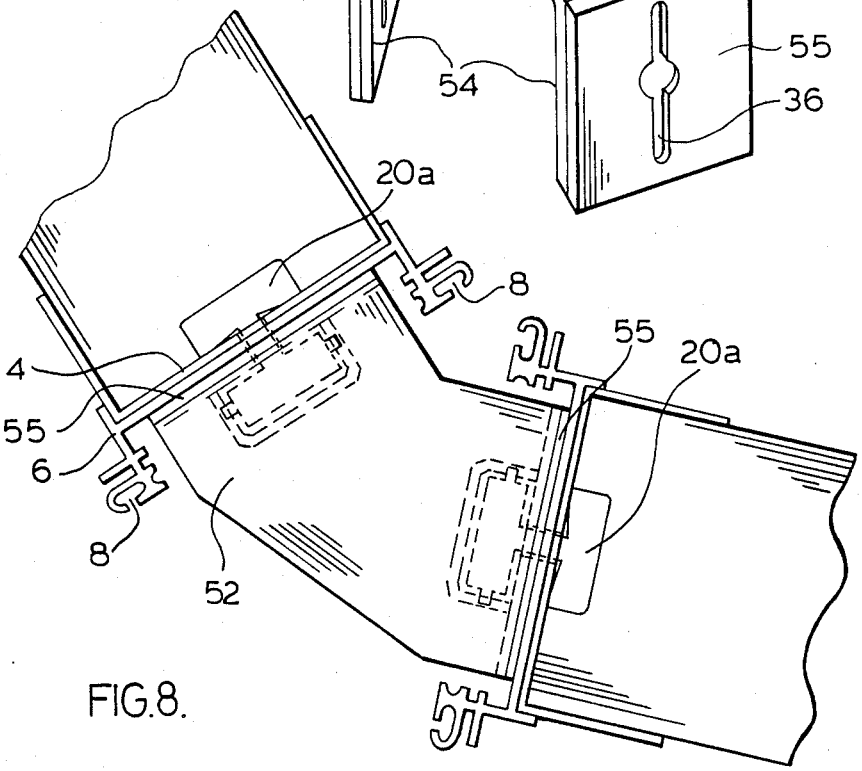
FIG.8.

PANEL LOCKING SYSTEM

BACKGROUND OF THE INVENTION

The present invention relates to office panelling systems and, in particular, relates to securing adjacent panels of a system to increase the structural integrity thereof.

Office panels for subdividing floor space have proven quite popular and one such system is shown in our U.S. Pat. No. 4,535,577 which issued Aug. 20, 1985. This system uses office panels which have an interior frame, normally of metal, to which decorative panels are releasably secured. These releasable panels allow access to the interior of the frame for such things as electrical wiring and telecommunication conduits and also allows replacement of the panel should it become damaged or obsolete. This system is in contrast to other panelling systems where a solid core is provided and raceways, if present, are provided at the bottom of the panel.

One problem with panelling systems, in general, is effective joining of adjacent panels to render stability to the system. In some cases, fasteners or brackets engage the top and bottom edges of the panel to lock one panel to an adjacent panel. Other panelling systems have taken a different approach and utilize a beam and post arrangement where the post and beam are generally mechanically fixed and panels are added between the posts. This system, although it provides excellent rigidity and stability, suffers in that it is more difficult to assembly and more difficult to change if required by the user.

Other systems use a plastic hinge-type connection, however it has been difficult to add sufficient rigidity to the system with this type of connector.

The advantages of the plastic hinge is full flexibility with respect to the angle at which the panels are connected, however, in practise, it has been necessary to add additional structural members to tie the panels in a given orientation.

There remains a need to provide a simple, strong securement system between panels which accommodates end to end alignment as well as different angles between panels, while strongly tying one panel to the next. The system need not be designed to satisfy all angles between panels, as accepted angles such as 90°, 120° and 135° may be sufficient. Ease of assembly is particularly important. The assembled panels should also have some ability to maintain a strong compressive force with changing conditions such that the biased mechanical connection is maintained.

Furthermore, the securement should serve to vertically align panels to improve the look of the system.

SUMMARY OF THE INVENTION

According to the present invention, a mechanical fastening means extends between the frames of adjacent panels to positively lock the panels in a predetermined configuration. The frames have been provided with slot-like openings which are aligned when the panels are in their assembled condition, and the fastening means extends through the slots and effects a positive lock of the panels.

According to an aspect of the invention, resilient abutment members are positioned between abutting edges of the panels to partially space the panels and provide some resiliency to ensure the mechanical connection remains snug. The slot-like openings provided in the frames cooperate with a fastening member which, in a first orientation, allows a portion of the fastening member to pass through the slots, and once so disposed, the fastening member is rotated in preparation for locking of one panel to the adjacent panel. In cases where panels are placed in end to end alignment, a single fastening means passes through the adjacent portions of the frames of the panels and exerts a compressive force maintaining the panels in an abutting relationship. In cases where the panels are at an angled orientation, inserts may be used where each panel is separately secured to the insert, and the insert forms part of the mechanical connection locking the panels in a predetermined orientation.

The securement system of the present invention provides positive locking of one panel to the next panel whereby the mechanical fastening means acts as a load transfer member, thus adding substantial rigidity to the system. This mechanical fastening is partially accomplished interior to the panel and preferably in the mid portion thereof and is concealed by the panel. Such a system adds structural stability to the overall panelling system when assembled, as forces are transferred between adjacent panels.

BRIEF DESCRIPTION OF THE DRAWINGS

Preferred embodiments of the invention are shown in the drawings wherein:

FIG. 1 is a partial perspective view of two panels in abutting relationship;

FIG. 2 is a partial perspective view showing the end frames of two panels about to be interconnected by clamping member;

FIG. 6 is a perspective view of a four-way connector used to join panels;

FIG. 7 is a perspective view of a three-way connector for joining panels;

FIG. 8 shows an angled connector interconnecting two panels; and

DETAILED DESCRIPTION OF THE PREFERRED EMBODIMENTS

Figure 3:
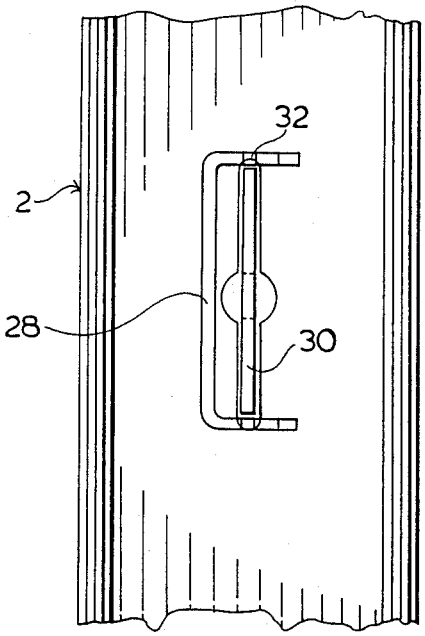
FIG. 3 is an end view showing the position of the clamping member for inserting the head of the clamping member through aligned slots in panels.
Figure 4:
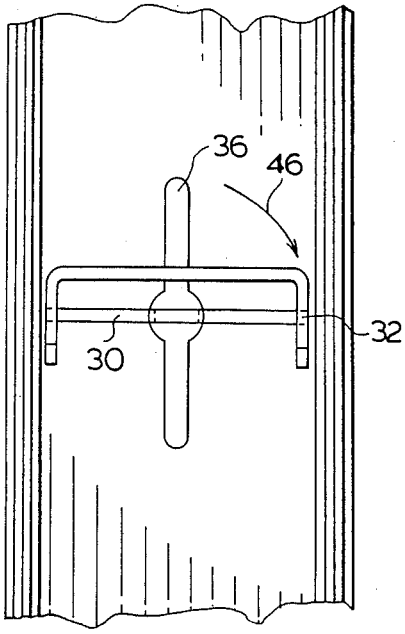
FIG. 4 is an end view showing the clamping member rotated in preparation for effecting clamping.

The office panels or partitions, generally shown as 1 in FIG. 1, have removable decorative exterior panels 2 which are carried by a panel frame, a portion of which is shown in the latter Figures. Panels of this type are shown in our U.S. Pat. No. 4,535,577.

In order to add stability to the office panelling system, panels placed in end to end abutment are secured by means of the clamping member generally shown as 20 in FIG. 2.

The clamping member is designed to pass through the frames 4 and the end caps 6 to engage the interior surface of the frame and effect a clamping action between frames. Each of the end caps include strip receiving slots generally shown as 8 which can receive abutting strips 10. The strip 10 is slidably received in a slot of one panel and engages the slot of an opposed panel. In FIG.

2, one of the frames has been provided with the abutment strips 10, but it is apparent that each frame could have an abutting strip 10 and it is immaterial which end cap carries the abutting strips, as long as the abutting strips are between opposed end caps and engaging an opposed strip receiving slot 8. These abutting strips are somewhat compressible and will add a degree of resiliency when the panels are connected. The strips also serve to provide opposed vertical engagement, oppose any movement caused by twisting forces between panels, and accurately vertically align panels.

In the case of factory installed strips are provided at one edge of each end of the panel and diagonally opposite for convenience of use.

The clamping member 20 has a head 22 secured at one end of the shank 26 such that the head and shank define a generally 'T' shape. The head includes panel engaging shoulders 24 spaced either side of the shank 26. At the opposite end of the shank an actuator 28 is pivoted to shank extension 30 at pivot points 32. The actuator includes camming surfaces 34 which engage the inner surface of one of the panel frames when the actuator is moved from a first position generally shown in FIG. 2 to a clamping position or second position generally shown in FIG. 5. The first position allows the clamping member to be appropriately received in the panel in preparation for clamping.

Figure 5:
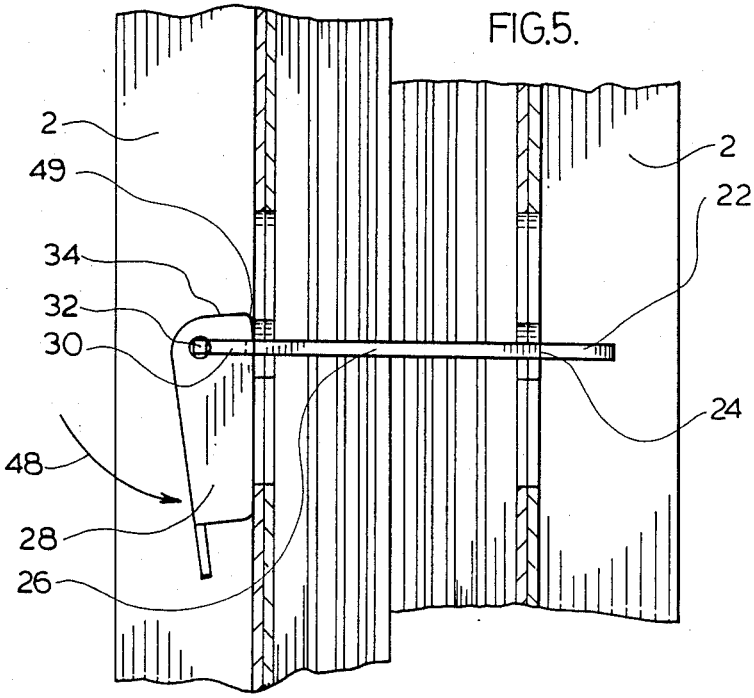
FIG. 5 is a side view showing the clamping member moved to a second position to effect clamping of two panels.

Operation of the clamping member can be appreciated from a review of FIGS. 2 through 5, where clamping member 20 is first inserted through aligned slots in the end frames of abutting panels in the manner shown by arrow 44, and passes through the first panel and through the end frame of the second panel such that the head is disposed to the interior of the frame of the second panel as shown in FIG. 5. Once the head 22 has been located within the interior of the frame of the other panel, the clamping member 20 is rotated as indicated at 46 from the position generally shown in FIG. 3 to the locking orientation of FIG. 4. The camming surfaces 34 of the actuator 28 are now disposed adjacent the edges of the end caps 6 where the structure has greater strength due to the underlying frame 4. The actuator is then rotated in the direction 48 past a point of maximum compression generally indicated as 49 to the second orientation which strongly biases the two panels, due to the compressive force exerted thereon.

The abutment strips 10 contact the opposite slot of the adjacent end cap and align the panels. The strips compress somewhat and provide controlled compression which serves to maintain pressure on the actuator 28. The actuator is thus biased to the second position of FIG. 5, as any movement of the actuator from this position requires a further compression of the strips as the actuator must move through the point of maximum compression provided at point 49 on the camming surface 34.

The cam surface of the actuator is shaped to define, relative to the pivot point 34, a short distance to allow insertion and positioning of the actuator in the panels. This short distance allows sufficient play to insert clamping member. The actuator, when moved to the second orientation, decreases the separation of the head 22 from the contact point of the camming surface to thereby produce a strong clamping force.

As generally shown in FIG. 2, access to the interior of the panels to expose the interior frames is required when the actuator 30 is physically located within one of the panels. The head 22 can be inserted through a slot 36 in a panel, making access to both panels unnecessary.

Various connectors are shown in FIGS. 6 through 8 and are used for securing panels in a non-linear fashion. FIG. 6 shows a four-way connector having a horizontal load carrying member 52 and downwardly extending connecting flanges generally shown as 54. Connecting flanges 54 carry, on the exterior face thereof, compressible cork surface 55 which add resiliency much in the way as strips 10. The downwardly extending flanges cooperate with the aligned slots in the panels to allow a modified clamping member, generally shown as **20*a*, pass through a panel and through a slot in one of the downwardly extending flanges 54 of the connecting member to connect the panel to the connector. The modified clamping member 20*a* is the same as clamping member 20, however the shank has been reduced in length to accommodate the reduced distance between the flange 54 and the end cap of a panel. Each of the downwardly extending planar flanges 54 has an elongate slot 36 similar to the panels to allow insertion of the head of the connecting member 20*a* to pass through the connecting member. The flanges 54 are sized to abut along one surface thereof the planar surface of the end cap adjacent the slot to ensure a strong mechanical connector where stress is reduced to distribution of the forces to a larger area. FIG. 7 shows a three-way connector, whereas FIG. 8** shows an angled connector, in this case, to accommodate an angle of about 135° between panels. Access to the panels is not necessary when connectors are used, however it may be more convenient to have at least one actuator within a panel for ease of assembly.

The planar, generally horizontal, load carrying portions 52 of the connectors provide the stiffness and therefore allow positive securement of one panel to the other at a predetermined angular relationship. Connectors would normally be provided adjacent the top and bottom of the panel.

The present invention uses a clamping member which acts much in the way of key which passes through appropriate slots in adjacent panels and is rotated to an engaging position where the shoulders 24 of the head 22 engage the rear or interior surface of the frame 4 of a panel. Once so rotated, the actuator 28 may be moved to a second position to produce a clamping action. The actuator is designed to provide a mechanical advantage in moving from the first position, which defines a somewhat loose connection between panels, to a firm clamping or second position where compression of the abutting strips or cork surfaces continues to exert tension on the clamping member.

The various slots provided in the end cap can be used for receiving decorative strips used to finish the end of the panel, or for receiving structural components to stack one component on top the other. Details of these features can be found from our prior patent.

The cooperation between the clamping member 20 and the abutment strips 10, partially received in opposed slots of an adjacent panel, initially align the panels and subsequently distribute the clamping force to along the opposed vertical faces of the panels. This cooperation reduces the number of clamping members required and, in most cases, two clamping members, one located adjacent the top and the other located adjacent the bottom of the panels, is sufficient to secure two aligned panels in abutting relationship. Depending upon the vertical extent of the panels, three clamps are used; with the third clamp being generally centrally located.

The connectors of FIG. 8 can be modified such that the downwardly extending flanges or the planar connecting portion 52 engages the end cap along opposed vertical portions, rendering rotation of the connector impossible. Such a connector would partially act in the manner of the strips described above.

Figure 9:
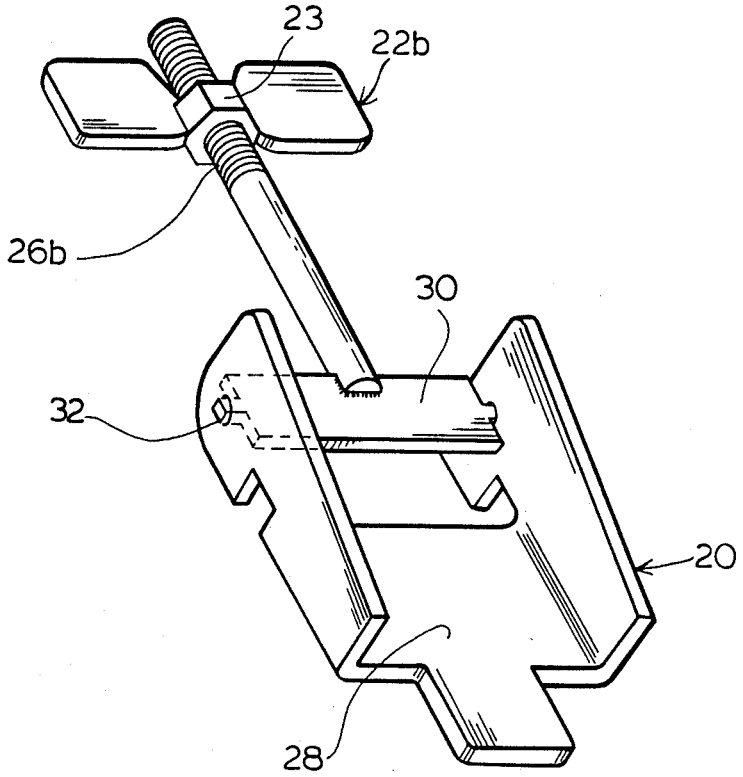
FIG. 9 is a modified clamp.

A further modified clamp **20*b* is shown in FIG. 9 wherein the shank 26*b* is a threaded rod and the nut 23 incorporated in the head 22*b* threadably receives the shank 26*b*. Head 22*b* can be adjusted on the shank 26*b*** to vary the spacing of the head from the lever and cam actuator. Other arrangements for adjusting the spacing are possible and such adjustability may allow a single clamp to be used for joining panels either in end to end relation or joining a panel to a connector.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. In an office panelling system, a clamp for securing two panels each of which has a frame, said clamp comprising a first portion having a head and a shank, said head extending either side of said shank to form at least a 'T' shaped configuration, said shank at an end opposite said head including a pivoted lever and camming member which, in a first orientation, defines a certain distance between said head and said lever and camming member and is movable to a second position defining a reduced distance relative to said first orientation, said lever and camming member being shaped to pass through a point of minimum spacing between said first and second orientations to create a bias maintaining said lever and camming member in said second orientation when effecting a clamping action, wherein said head is generally planar and said shank and head act as a key which is inserted through slots in panels and rotated, once so inserted, to a clamping orientation with said head engaging an interior surface of the frame of an office panel with said camming member engaging an interior surface of the frame of an adjacent panel, and wherein said camming member includes two camming surfaces spaced either side of said shank and generally opposite panel engaging surfaces of said 'T' shaped head.

2. In an office panelling system as claimed in claim 1 including resilient members selectively received in slots at the ends of said panels and engage opposed slots of an opposed panel.

3. In an office panelling system as claimed in claim 2 wherein said resilient members include in cross section a head received in an edge of a panel, a forward abutment edge and two shoulders, said shoulders being spaced to opposite sides of said abutment edge.

4. In combination, two similar office panels placed in abutting end to end relationship with each panel having a metal framework with vertically extending channels at the ends of the panel, said vertically extending channels including aligned slots therethrough used to effect clamping of one panel to an adjacent panel, and a clamp configured to cooperate with said aligned slots and adjacent vertically extending channels, said clamp comprising a first portion having a head and a shank, said head extending either side of said shank to form at least a 'T' shaped configuration, said shank at an end opposite said head including a pivoted lever and camming member which, in a first orientation, defines a certain distance between said head and said lever and camming member and is movable to a second position defining a reduced distance relative to said first orientation, said lever and camming member being shaped to pass through a point of minimum spacing between said first and second orientations to create a bias maintaining said lever and camming member in said second position when effecting a clamping action, said 'T' shaped head freely passing through aligned slots of adjacent panels placed in abutting end to end relationship when said clamp is in said first orientation to position said 'T' shaped head interior to one panel with said lever and camming member interior to the adjacent panel whereafter said clamp is rotatable about longitudinal axis of said shank to position said 'T' shaped head for clamping of said panels by placing said clamp in said second position with said 'T' shaped head in abutment with the vertical channel of one panel and said camming member in abutment with opposed vertical channel of the other panel and exerting a force maintaining said panels in abutting relationship and wherein said camming member includes two camming surfaces spaced either side of said shank and generally opposite panel engaging surfaces of said 'T' shaped head.

5. In the combination of claim 4 including compressible resilient members disposed between adjacent panels and held in slots at the ends of said panels to be compressed when said clamp is in said second position.

* * * * *